US008007135B2

(12) United States Patent
Xiang et al.

(10) Patent No.: US 8,007,135 B2
(45) Date of Patent: Aug. 30, 2011

(54) LED LAMP

(75) Inventors: Qian Xiang, Shenzhen (CN); Guang Yu, Shenzhen (CN)

(73) Assignees: Fu Zhun Precision Industry (ShenZhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 384 days.

(21) Appl. No.: 12/409,514

(22) Filed: Mar. 24, 2009

(65) Prior Publication Data

US 2010/0157592 A1 Jun. 24, 2010

(30) Foreign Application Priority Data

Dec. 23, 2008 (CN) ..... 2008 1 0306483

(51) Int. Cl.
*F21V 29/00* (2006.01)
*F21S 4/00* (2006.01)

(52) U.S. Cl. ..... 362/294; 362/249.02

(58) Field of Classification Search ..... 362/294, 362/247, 249.02
See application file for complete search history.

(56) References Cited

U.S. PATENT DOCUMENTS

| | | | | |
|---|---|---|---|---|
| 2009/0147518 | A1* | 6/2009 | Shuai et al. | 362/249.02 |
| 2009/0303718 | A1* | 12/2009 | Zheng et al. | 362/249.02 |
| 2010/0053963 | A1* | 3/2010 | Yang et al. | 362/249.02 |
| 2011/0026253 | A1* | 2/2011 | Gill | 362/249.02 |

FOREIGN PATENT DOCUMENTS

| | | | |
|---|---|---|---|
| CN | 2752600 | Y | 1/2006 |
| CN | 101260989 | A | 9/2008 |
| CN | 101320774 | A | 12/2008 |

* cited by examiner

*Primary Examiner* — David V Bruce
(74) *Attorney, Agent, or Firm* — Altis Law Group, Inc.

(57) ABSTRACT

An LED lamp includes a heat sink, a plurality of LED modules and a reflector. The heat sink has a conical wall. The LED modules are attached to an inner surface of the wall. The reflector is engaged in the heat sink. The reflector has an outer surface facing and angled with the LED modules. Light generated by the LED modules is reflected by the outer surface of the reflector to radiate out of the LED lamp.

15 Claims, 4 Drawing Sheets

LED LAMP

BACKGROUND OF THE DISCLOSURE

1. Field of the Disclosure

The disclosure relates to light emitting diodes (LEDs) for lighting and, more particularly, to an LED lamp providing soft light with even brightness.

2. Description of Related Art

The technology of light emitting diodes has rapidly developed in recent years, allowing expansion of application from indicators to include illumination. With its features of long-term reliability, environmental friendliness and low power consumption, the LED is viewed as a promising alternative for recent lighting products.

A related LED lamp includes a heat sink and a plurality of LED modules including LEDs, attached to an outer surface of the heat sink to enable dissipation of heat generated by the LEDs. The outer surface of the heat sink is generally planar with the LEDs arranged closely. However, such mounting of the LEDs on the planar outer surface of the heat sink fails to provide three-dimensional, soft illumination with even brightness such as is required for applications like a park lamp or a decorative lamp.

What is needed, therefore, is an LED lamp which can overcome the limitations described.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION OF THE DISCLOSURE

Figure 1:
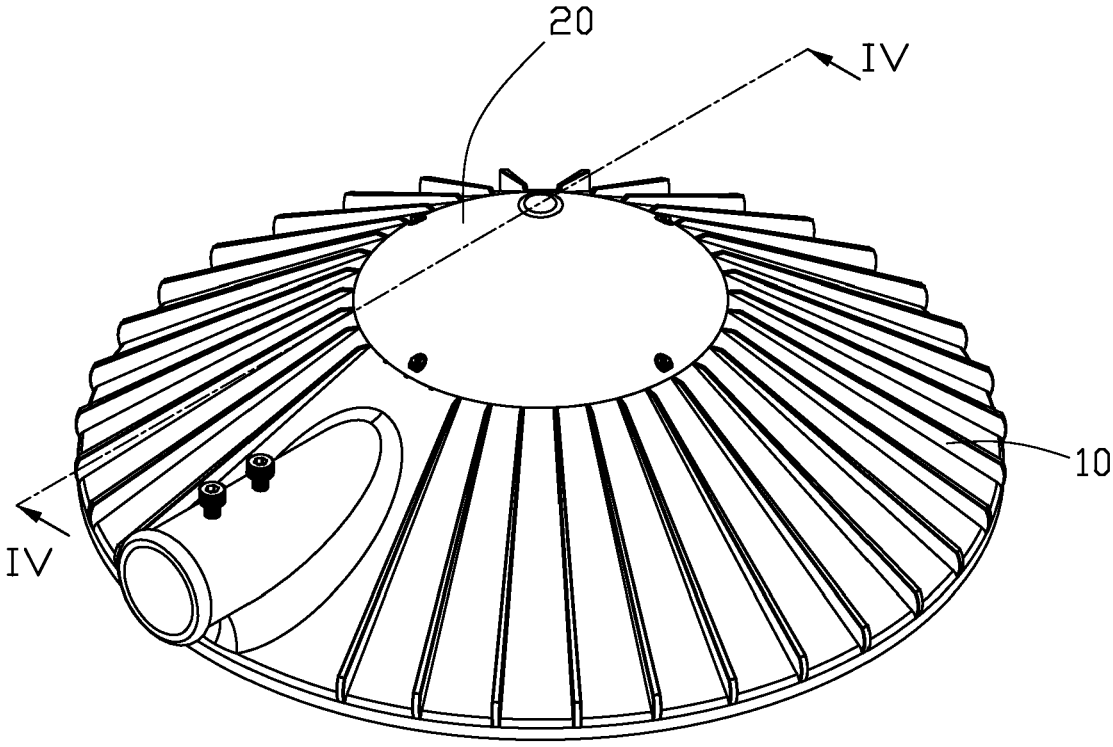
FIG. 1 is an isometric, assembled view of an LED lamp in accordance with the disclosure of the disclosure.
Figure 2:
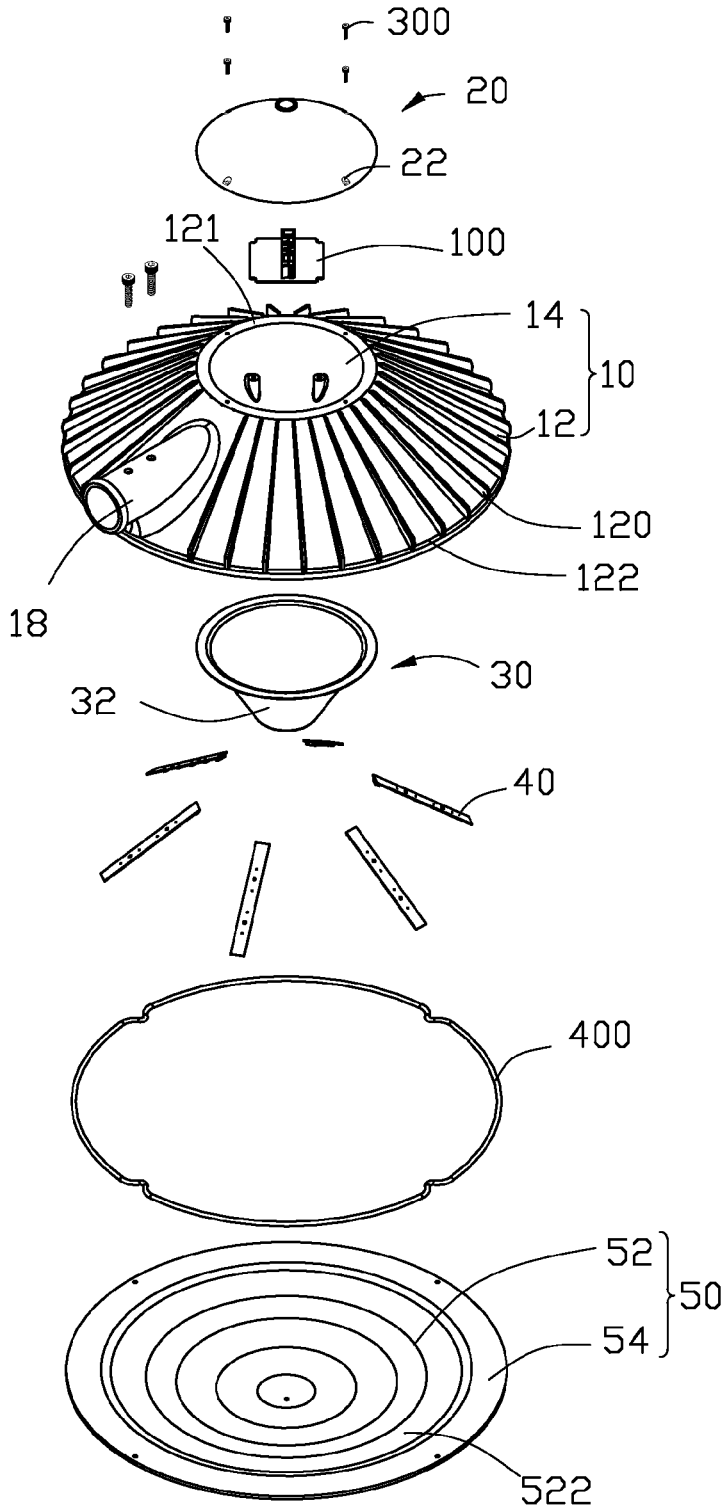
FIG. 2 is an exploded view of the LED lamp of FIG. 1.
Figure 3:
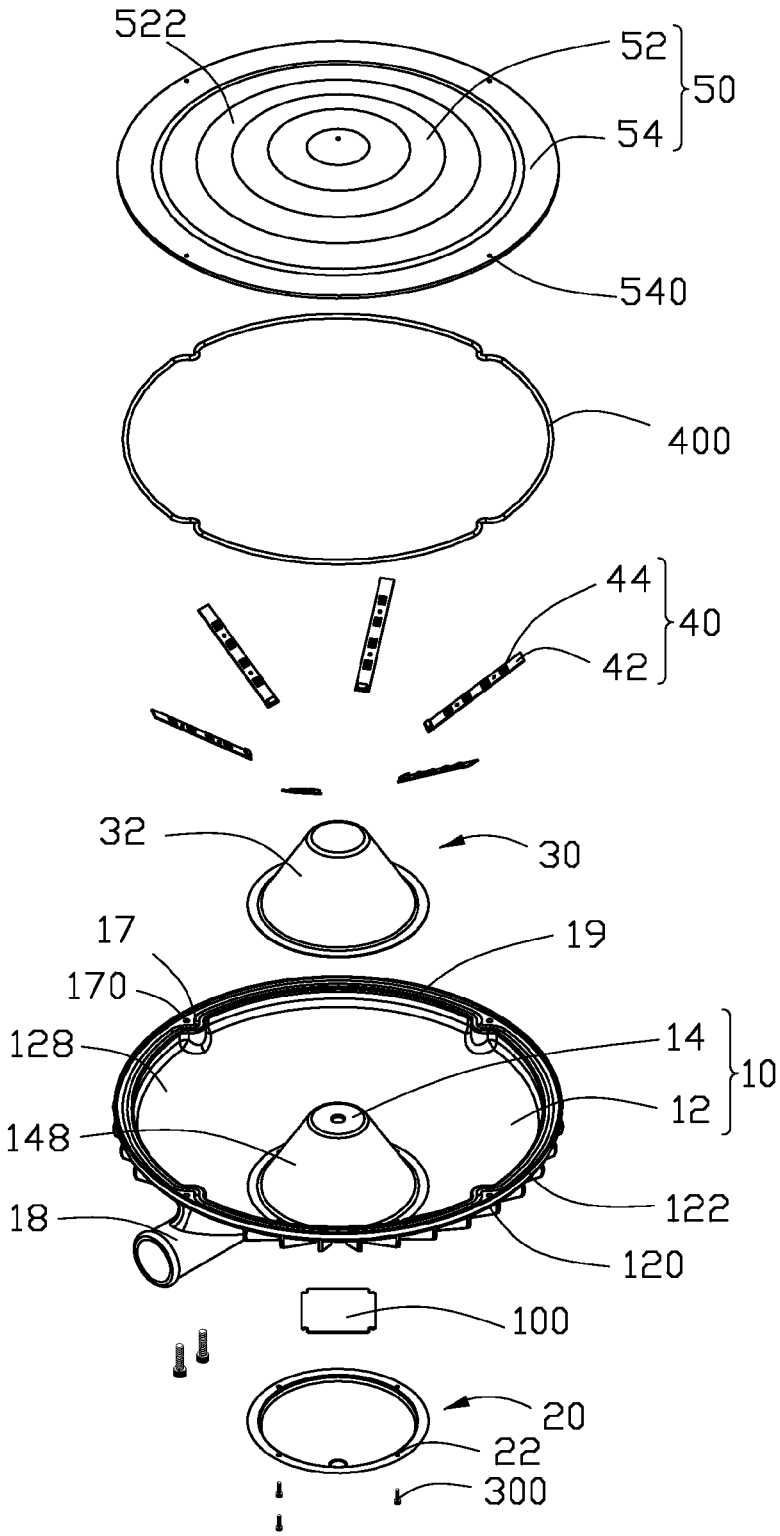
FIG. 3 is an inverted view of the LED lamp of FIG. 2.

Referring to FIGS. 1-3, an LED lamp in accordance with the disclosure is illustrated. The LED lamp comprises a shell-shaped heat sink 10, a cover 20 mounted on the heat sink 10, a reflector 30 disposed in the heat sink 10, a plurality of LED modules 40 disposed in the heat sink 10 facing the reflector 30, and an envelope 50 engaging a bottom of the heat sink 10. The heat sink 10 and the envelope 50 cooperatively form a receiving chamber receiving the reflector 30 and the LED modules 40 therein.

The heat sink 10 is integrally formed of a metal with good heat conductivity such as aluminum, copper or alloy thereof. The heat sink 10 is configured as a conical frustum or segment. The heat sink 10 comprises an umbrella-shaped wall 12 and a depressed body 14 extending downwardly and inwardly from a top thereof. The wall 12 is configured as a hollow conical frustum or segment. The wall 12 has a circular top edge 121 at a top thereof and a circular bottom edge 122 at a bottom thereof. A diameter of the top edge 121 is smaller than that of the bottom edge 122 of the wall 12. Cross sections of the wall 12 gradually increase in diameter from the top edge 121 to the bottom edge 122. The bottom edge 122 of the wall 12 forms a circular opening (not labeled). The wall 12 has an angled inner surface 128 and an outer surface (not labeled). A plurality of spaced fins 120 extend evenly and radially from the outer surface of the wall 12. The fins 120 extend from the top edge 121 to the bottom edge 122 along the wall 12. A cylindrical holder 18 extends integrally and outwardly from a side of the outer surface of the wall 12 for mounting the LED lamp to a pole or other support (not shown). The wall 12 evenly extends a plurality of tabs 17 inwardly from the bottom edge 122 thereof. The tabs 17 each define a mounting hole 170 therein for mounting the envelope 50 to the heat sink 10. The wall 12 defines an annular groove 19 at the bottom of the wall 12 receiving a waterproof cushion 400 to prevent moisture entering the LED lamp.

The depressed body 14 is configured as an inverted hollow frustum. The depressed body 14 and the wall 12 have a common axis. The depressed body 14 has a circular top end (not labeled) extending downwardly from the top edge 121 of the wall 12 and a circular bottom end (not labeled). The depressed body 14 defines a chamber (not labeled) at the top of the heat sink 10 receiving a driving circuit module 100 therein. A diameter of the bottom end is smaller than that of the top end of the depressed body 14. Cross sections of the depressed body 14 gradually decrease in diameter from the top end to the bottom end. Thus, the depressed body 14 has an angled curved surface 148 defined at an acute angle with respect to the inner surface 128 of the wall 12. The curved surface 148 is separated from the inner surface 128 of the wall 12 from a top to a bottom of the heat sink 10.

Figure 4:
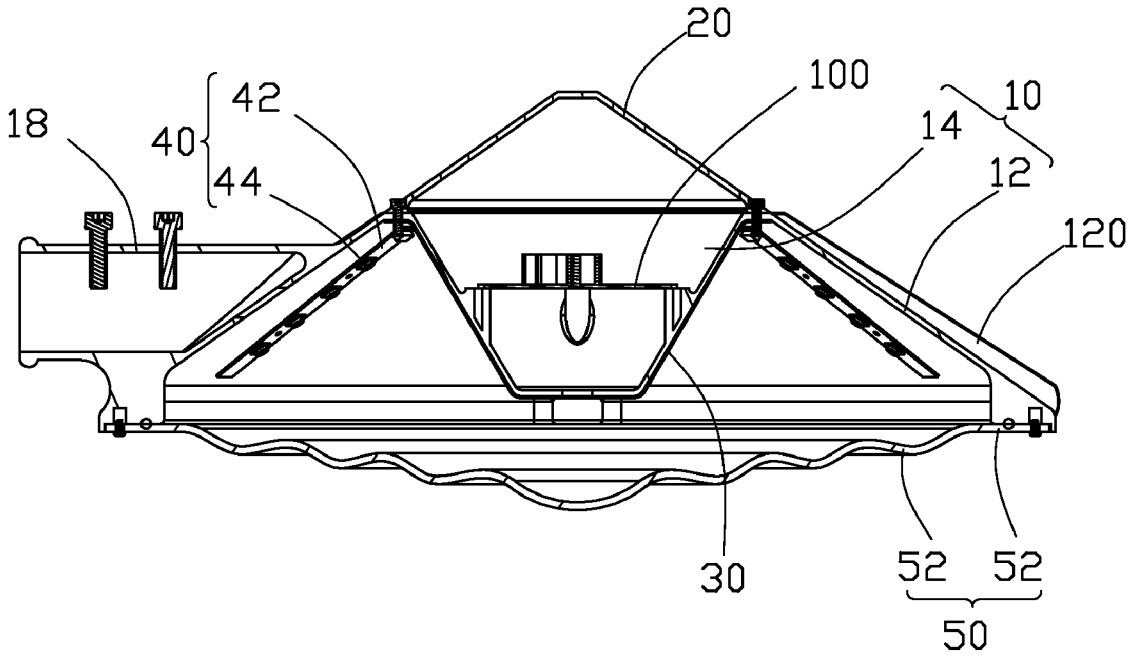
FIG. 4 is a cross-section of the LED lamp of FIG. 1, taken along line IV-IV thereof.

Referring to FIGS. 2-4, the cover 20 is conical with a bottom end correspondingly mounted on the top of the wall 12 of the heat sink 10. The cover 20 defines a plurality of through holes 22 near a bottom edge therein receiving a plurality of fasteners 300 to fix the cover 20 onto the heat sink 10. The driving circuit module 100 is received in the chamber of the depressed body 14 and covered by the cover 20.

The reflector 30 encloses the depressed body 14 and is configured as an inverted hollow conical frustum or segment corresponding to the depressed body 14. The reflector 30 is tightly attached on the curved surface 148 and the bottom of the depressed body 14. The reflector 30 has an outer surface face 32 and is angled with the LED modules 40. Moreover, the outer surface 32 of the reflector 30 is positioned symmetrically relative to a central axis of the reflector 30.

Each of the LED modules 40 includes an elongated printed circuit board 42 mounted on the inner surface 128 of the wall 12 and a plurality of LEDs 44 mounted on the printed circuit board 42. The LED modules 40 are evenly and radially mounted on the inner surface 128 of the wall 12 from the top edge 121 to the bottom edge 122. Thus, heat generated by the LED modules 40 is absorbed by the wall 12 of the heat sink 10 and transferred to the fins 120 to be dissipated into the exterior. The LED modules 40 are thus cooled and operate within an allowable temperature range.

The envelope 50 comprises a central transparent plate 52 and an outer annular flange 54 engaging the bottom edge 122 of the wall 12, to mount the envelope 50 to the heat sink 10. The flange 54 defines a plurality of through holes 540 corresponding to the mounting holes 170 of the tabs 17 of the wall 12. Fasteners (best seen in FIG. 4 and not labeled) extending through the through holes 540 of the envelope 50 engage the mounting holes 170 of the wall 12 to mount the envelope 50 onto the heat sink 10. The transparent plate 52 is substantially disc-shaped with a center lower than an edge thereof. The transparent plate 52 forms a plurality of annular steps 522 outwardly extending at a bottom thereof in sequence. The steps 522 gradually increase in diameter upwardly and outwardly from the center to the edge of the envelope 50. The steps 522 of the transparent plate 52 enhance a refractive index of the transparent plate 52 to guide light generated by the LED modules 40 to generate an increased illumination area. Further, light generated by the LED modules 40 is repeatedly reflected by the steps 522 of the transparent plate 52 and the reflector 30. Thus, the light is propagated omnidirectionally toward the outside of the LED lamp with a soft intensity.

In use, the LED modules 40 face the reflector 30 and the transparent plate 52. A part of the light generated by the LED modules 40 is directly transmitted through the transparent plate 52. Other parts of the light generated by the LED modules 40 are reflected by the outer surface 32 of the reflector 30 and then through the transparent plate 52. The light can thus be transmitted or reflected omnidirectionally toward the exterior with a soft intensity and even brightness, making it suitable for application as a park lamp or decorative lamp. The outer surface 32 of the reflector 30 angling with the LED module 40 creates light that can be reflected multidimensionally, increasing the illumination area. Furthermore, the light propagating through the steps 522 of the transparent plate 52 toward the ground can produce a plurality of annular patterns, thereby producing a visually appealing light effect.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. An LED (light emitting diode) lamp, comprising:

a heat sink comprising a conical wall;

a plurality of LED modules attached to an angled inner surface of the wall;

a reflector engaged in the heat sink, having an outer surface facing and angled with the LED modules;

wherein light generated by the LED modules is reflected by the outer surface of the reflector to radiate out of the LED lamp.

2. The LED lamp as claimed in claim 1, wherein the reflector has a top end engaging the wall of the heat sink and a bottom end smaller than the top end.

3. The LED lamp as claimed in claim 2, wherein the reflector is configured as an inverted hollow conical frustum or segment, and the outer surface of the reflector is conical.

4. The LED lamp as claimed in claim 3, wherein the reflector and the wall of the heat sink have a common axis.

5. The LED lamp as claimed in claim 1, wherein the wall is configured as a hollow conical frustum or segment.

6. The LED lamp as claimed in claim 1, wherein cross sections of the wall gradually increase in diameter from a top edge to a bottom edge of the wall.

7. The LED lamp as claimed in claim 6, wherein the wall comprises a plurality of fins extending at an outer surface of the wall from the top edge to the bottom edge of the wall.

8. The LED lamp as claimed in claim 7, wherein the LED modules each comprise an elongated printed circuit board mounted on the inner surface of the wall and a plurality of LEDs mounted on the printed circuit board, the printed circuit boards extending from the top edge to the bottom edge of the wall.

9. The LED lamp as claimed in claim 1, further comprising a bowl-shaped envelope engaged a bottom of the heat sink.

10. The LED lamp as claimed in claim 9, wherein the envelope forms a plurality of annular steps around an axis of the envelope.

11. The LED lamp as claimed in claim 1, wherein the heat sink comprises a depressed body extending downwardly from a top edge of the wall, the reflector tightly mounted on the depressed body.

12. An LED lamp, comprising:

a shell comprising a wall having a conical inner surface;

a plurality of LED modules attached to the inner surface of the shell;

an inverted frustum-shaped reflector fixed in the shell, the reflector having a conical outer surface, wherein light generated by the LED modules is reflected by the outer surface of the reflector to radiate out of the LED lamp.

13. The LED lamp as claimed in claim 12, wherein the shell comprises a curved wall and a depressed body extending downwardly from a top of the wall, the reflector being tightly mounted on the depressed body.

14. The LED lamp as claimed in claim 12, wherein the shell is integrally formed of a metal with good heat conductivity.

15. The LED lamp as claimed in claim 12, further comprising an envelope engaging a bottom of the shell and a waterproof cushion sandwiched between the shell and the envelope.

* * * * *